United States Patent [19]

Chretien

[11] Patent Number: 4,684,548

[45] Date of Patent: Aug. 4, 1987

[54] METHOD FOR MODIFYING THE SURFACE STATE OF MATERIALS

[75] Inventor: Jean-Basile Chretien, Paris, France

[73] Assignee: AG-JBC (Sarl), Paris, France

[21] Appl. No.: 683,269

[22] PCT Filed: Mar. 21, 1984

[86] PCT No.: PCT/FR84/00072

§ 371 Date: Nov. 19, 1984

§ 102(e) Date: Nov. 19, 1984

[87] PCT Pub. No.: WO84/03664

PCT Pub. Date: Sep. 27, 1984

[30] Foreign Application Priority Data

Mar. 25, 1983 [FR] France ..... 83 04908

[51] Int. Cl.[4] ..... B05D 5/00; B05D 1/06; B05D 1/12; B05D 1/14

[52] U.S. Cl. ..... 427/197; 427/199; 427/200; 427/201; 427/202; 427/203; 427/204; 427/205; 427/206

[58] Field of Search ..... 427/202, 203, 297, 199, 427/200, 204, 205, 206, 201

[56] References Cited

U.S. PATENT DOCUMENTS

| | | | |
|---|---|---|---|
| 128,148 | 6/1872 | Hutchings | 427/199 X |
| 574,332 | 12/1896 | Johnston | 427/206 X |
| 1,927,290 | 9/1933 | Lamb | 427/197 X |
| 1,969,569 | 8/1934 | Malocsay | 427/197 |
| 2,069,470 | 2/1937 | Ariotti | 427/206 |
| 2,695,244 | 11/1954 | Fountain | 427/200 |
| 3,336,149 | 8/1967 | Fox et al. | 427/206 X |
| 4,031,281 | 6/1977 | Keeling | 427/206 X |

OTHER PUBLICATIONS

PCT/FR84/00072 to Chretien, published 27 Sep. 1984, Abstract.

*Primary Examiner*—Evan K. Lawrence
*Attorney, Agent, or Firm*—Oblon, Fisher, Spivak, McClelland & Maier

[57] ABSTRACT

A process for modifying the surface condition of materials comprises applying simultaneously to the surface of a material a plurality of typo-offset, silk screen printing or offset inks or varnishes having different polymerization temperatures and polymerization speeds, predrying at an appropriate temperature and for a length of time sufficient for polymerizing a certain type of ink(s), applying to the treated surface at least one batch of particles which adhere exclusively to not yet polymerized inks, removing the excess particles of a batch by suction and/or blowing and finishing the drying at a temperature and for a length of time appropriate for completing the polymerization of all the types of ink.

6 Claims, No Drawings

METHOD FOR MODIFYING THE SURFACE STATE OF MATERIALS

BACKGROUND OF THE INVENTION

1. Field of the Invention

The present invention relates to a new process for modifying the surface condition of the most diverse materials. It relates more particularly to a new relief offset printing process.

2. Description of the Prior Art

The multiple facilities for producing offset blocks and plates, the flexibility offered by the mounting for page setting, the ease of storing films and type molds, the possibility of printing in colors on relatively ordinary media, explain the importance of offset in the printing of packings, catalogs, periodicals, books, etc. Rotary offset printing allows printing to be carried out without pressure on practically all surfaces. Offset inks must satisfy a very lage number of physio-chemical requirements and have defined flow, coloring and drying properties on the support medium, they must without accident play their role as water repellent substances in dynamic balance with the water and the plate. Because of the rotary movement of offset presses which allows much higher speeds than the reciprocal movement of lithographic presses, for example, the offset process has taken its place among the great printing processes. However, this process has an important drawback: the surfaces thus treated and printed have after drying an absolutely uniform relief. If it is desired to obtain a less uniform, more heterogeneous, and more artistically decorated surface, in accordance with the presently known techniques, recourse must be had to compliated and costly procedures such for example as mechanical deformations of the support medium. Furthermore, the different support media and surfaces must be able to withstand these different mechanical stresses. Other techniques such as flocking, the use of inks containing swelling agents and a succession of a plurality of silk screen impressions given unsatisfactory results or are economically very expensive or else can only be applied to perfectly flat surfaces.

The aim of the present invention is then to provide a relief offset printing process which answers better the requirements of practice than the processes known heretofor and used for the same purpose, more especially in that it allows relief to be obtained of as large a variety as desired, in that it may be applied to all surfaces and all materials and in that it is simple, easy and economical to carry out.

SUMMARY OF THE INVENTION

The aim of the present invention is to provide a process for modifying the surface condition of different materials and more especially a relief offset printing process, wherein a plurality of polymerizable typo-offset, silk screen printing or offset inks having different polymerization temperatures and polymerization speeds are used simultaneously, predrying is carried out at an appropriate temperature and for a time sufficiently long for polymerizing a certain amount and a certain type of ink, particles of charges, that is batches, which adhere exclusively to the not yet polymerized inks are applied to the printed surface, the excess particles are removed by suction and/or blowing and the drying is finished at a temperature and for a length of time appropriate for completing the polymerization of the whole of the ink present and of all the types of ink. A relief design is thus produced upon the surface.

The inks and varnishes are chosen depending on the nature of the material whose surface is to be modified. The different charges may be applied in one or more operations. Modification of the surface condition is easily carried out and the decorative effect obtained—particularly for packings—are truly extraordinary.

The charges, that is batches, which may be used for applying on the not yet polymerized inks may be of different chemical natures and of different colors. In accordance with the invention, the particles of each batch comprise mica, expanded mica, luster forming base, expansible plastic foam, colloidal silica, metal powders, cork powder, swelling agents, flowing particles or flocks, leather powder, plastic material powder, asbestos powder, rubber powder, glass microballs, luminescent or phosphorescent products, etc.

These different particles may be applied and distributed either by spraying or by means of an ink trough.

According to an advantageous embodiment of the process of the invention, after application of the charged particles, the whole of the treated surface is varnished so as to reinforce the solidity of the decoration thus obtained. The process of the invention thus allows surfaces to be obtained at will having a whole range of colors and reliefs. It allows more particularly surfaces to be obtained having irregular thicknesses with rounded edge and remarkable decorative effect.

DESCRIPTION OF THE PREFERRED EMBODIMENT

In addition to the above arrangements, the invention comprises further arrangements which will become clear from the following description which refers to one embodiment of the process of the invention.

It should however be understood that this example is given solely by way of illustration of the subject of the invention, of which it forms in no wise a limitation.

EXAMPLE OF A SURFACE TREATMENT

Relief printing on boxes for bottles

Four inks of different colors (250 g of each) are prepared for decorating 50% of the surface of 50,000 boxes of 0.25 liter.

Two inks are quick drying inks, the other two slow polymerization inks. As soon as the quick drying inks have taken on solid consistency, the boxes are sprinkled by means of a conventional hopper and spraying nozzle with 4.25 grams of a mixture of swelling powder and colloidal silica. This charge adheres exclusively to the parts of the surface coated with a not yet polymerized ink. The charge excess is recovered by suction, the loss scarcely exceeding 5% of the charge used. The boxes are then oven dried for 25 minutes at 110° C. and the ink thus polymerized retains the charge applied in an irreversible way.

If desired the boxes may be given a finishing coat of varnish.

The decorative effect obtained is extraordinary.

As is clear from the foregoing, the invention is in no wise limited to those of its embodiments and the modes of application which have just been described more explicitly; it embraces on the contrary all the variants which may occur to a technicien skilled in the matter, without departing from the scope or spirit of the present invention.

What is claimed is:

1. A process for producing a relief design upon a surface of a material which comprises applying simultaneously a plurality of polymerizable typo-offset, silk screen printing or offset inks or varnishes having different polymerization temperatures and polymerization speeds to different parts of said surface, predrying the applied inks or varnishes at an appropriate temperature and for a period of time sufficient for polymerizing at least one but not all of the inks or varnishes, thereafter applying at least one batch of particles on to said surface which particles adhere exclusively to the not yet polymerized inks or varnishes, removing the excess particles of the batches by suction and/or blowing, and finishing the drying at a temperature and for a length of time appropriate for completing the polymerization of all the types of inks or varnishes.

2. The process as claimed in claim 1, wherein each batch applied to the surface comprises particles of mica, expanded mica, a luster forming base, an expansible plastic foam, collodial silica, metal powders, cork powder, swelling agents, flocking particles, leather powder, asbestos powder, rubber powder, glass microballs, luminescent products or phosphorescent products.

3. The process as claimed in claim 2, wherein different batches are applied in several operations.

4. The process as claimed in claim 2, wherein a batch is applied by spraying.

5. The process as claimed in claim 2, wherein a batch is applied by means of an ink trough.

6. The process as claimed in claim 2, wherein, after application of the particles of the batches, the whole of the treated surface is varnished.

* * * * *